United States Patent [19]

Hebert et al.

[11] Patent Number: 4,784,143

[45] Date of Patent: Nov. 15, 1988

[54] METHOD FOR CORRECTING HUMAN GAIT BY WEIGHTING OF FOOTWEAR

[76] Inventors: Steven L. Hebert, 05986 Canary Rd.; Theodore D. Ross, 88834 Highway 101, both of Florence, Oreg. 97439

[21] Appl. No.: 121,411

[22] Filed: Nov. 16, 1987

[51] Int. Cl.[4] ..... A61F 5/14

[52] U.S. Cl. ..... 128/585; 36/132; 272/119

[58] Field of Search ..... 128/583, 585, 581, 586; 36/132; 272/96, 119

[56] References Cited

U.S. PATENT DOCUMENTS

| | | | |
|---|---|---|---|
| 5,393 | 12/1847 | Chamberlin | 128/805 |
| 293,692 | 2/1884 | Wemple et al. | 168/25 |
| 470,815 | 3/1892 | Barton | 168/25 |
| 757,983 | 4/1904 | Vaile | 272/119 X |
| 771,938 | 10/1904 | Ruhl | 36/132 X |
| 1,340,700 | 5/1920 | Dahl | 128/583 |
| 1,515,665 | 11/1924 | Eck | 36/132 |
| 1,768,491 | 6/1930 | Richardson | 128/586 X |
| 2,114,790 | 4/1938 | Venables | 272/119 |
| 2,390,416 | 12/1945 | Bettmann | 128/585 |
| 2,424,159 | 7/1947 | Goetz | 272/119 X |
| 2,529,419 | 11/1950 | Quartullo | 168/25 |
| 2,546,408 | 3/1951 | Riggs | 128/619 |
| 2,616,190 | 11/1952 | Darby | 128/585 |
| 3,114,982 | 12/1963 | McGowan | 36/132 |
| 3,517,928 | 6/1970 | Shanahan | 272/119 |
| 3,785,646 | 1/1974 | Ruskin | 272/119 |
| 4,033,054 | 7/1977 | Fukuoka | 36/11.5 |
| 4,252,315 | 2/1981 | Kimura | 272/119 |
| 4,364,188 | 12/1982 | Turner et al. | 36/31 |
| 4,407,079 | 10/1983 | Chiroff | 36/132 X |
| 4,458,432 | 7/1984 | Stempski | 36/132 |
| 4,484,397 | 11/1984 | Curley, Jr. | 36/92 |
| 4,499,674 | 2/1985 | Olivieri | 36/117 |
| 4,674,203 | 6/1987 | Göller | 36/44 |
| 4,686,781 | 8/1987 | Bury | 36/132 |

FOREIGN PATENT DOCUMENTS

| | | | |
|---|---|---|---|
| 14295 | 4/1897 | Switzerland . | |
| 18208 | of 1899 | United Kingdom | 128/581 |

*Primary Examiner*—Paul T. Sewell
*Assistant Examiner*—Moshe I. Cohen
*Attorney, Agent, or Firm*—John F. Ingman

[57] ABSTRACT

A method for correcting human gait involving the application of weights to footwear so as to dynamically align and balance the foot during running or walking motion. Steps include the determination of fore-aft misalignment; the application of weight to the outside edge of the footwear if the misalignment is toe-out, or to the inside edge if the misalignment is toe-in; and iterative redetermination of fore-aft alignment while adding, removing or repositioning the weights upon the footwear until fore-aft alignment is achieved. Dynamic roll alignment may additionally be corrected by applying weight on the outside edge of footwear for pronation, or on the inside edge for supination, with iterative redetermination of dynamic roll alignment and corresponding adjustment of weight and location of previously positioned fore-aft alignment weight, so as to provide total foot alignment and balance. The foot having the greater fore-aft misalignment may be determined by the identification of the non-dominant foot, such foot being preferred for first correction.

8 Claims, 3 Drawing Sheets

METHOD FOR CORRECTING HUMAN GAIT BY WEIGHTING OF FOOTWEAR

BACKGROUND OF THE INVENTION

1. Field of the Invention

The present invention involves a method for correcting the human gait, and, more particularly, a method for altering and correcting biomechanical abnormalities and motion misalignment in the human gait through the addition of weights to footwear.

2. Description of the Prior Art

In the bipedal pattern of motion, the sequential motion carry-through pattern of the foot is: swing, strike, foot roll, lift off, swing, strike, etc. Persons with a "normal" foot to leg structure make contact (strike) on the outside of the heel, then pronate (turn the arch inwards) to absorb the shock, then externally rotate the leg to allow the foot to become a rigid lever for "lift off". At the point following foot roll, when the foot is flat upon the ground, the foot ideally is oriented in a fore-aft alignment with respect to the direction of travel. If the motion connection between the hip-knee-foot is misaligned, the "naturally" straight gait is thrown off.

Where the foot is not fore-aft aligned with respect to the direction of travel, but rather is "toe-out", the usual result is pronation of the foot as it attempts to drive or lift off from that toe-out position. If the foot is "toe-in", it usually will drive or lift off from that position, resulting in supination. Both pronation and supination are undesirable foot positions, from the standpoint of both motion efficiency and injury.

It has been found that one of the reactions to the improper positioning is hypermobility of the pelvis which is the cause of almost all injuries to the pelvis and hip while walking or running. Hypermobility of the pelvis is an overmovement from the anterior to the posterior of the femoral head and excessive sacroiliac motion on the same side. In the normal anterior to posterior movement, as in walking or running, the anterior motion of the femur is controlled primarily by the quadriceps (extender muscle on thigh) and psoas muscles (muscle on front side of spine connecting the femoral head). In the hypermobility segment of motion, the leg unnaturally recruits the adductor muscles (groin area) and the sartorius (iliac based muscle which flexes hip and thigh). In addition, the recruitment of the adductor muscles to aid in the forward movement of the leg also tends to carry the leg into an undesired cross-over position.

This excessive pelvis motion can also precipitate injuries to the knee and associated muscles while walking or running. The hypermobility of pelvis and knee is apparently caused by a motion fixation of the ankle and foot, wherein resulting attempts by muscles to self-correct the resulting misalignment not only throw the gait off, but also may be injurious to the foot, ankle, knee, hip and pelvis.

There is a need to develop a method or procedure whereby injuries occurring while walking or running are minimized by providing proper fore-aft alignment of the foot during the dynamics of motion. Such procedure would also increase the efficiency of walking and running.

SUMMARY OF THE INVENTION

The present invention provides a method for correcting human gait which is designed to satisfy the aforementioned need. The invention involves the application of weights to footwear so as to dynamically align and balance the foot during the running or walking sequence of motion.

Accordingly, a method of dynamic alignment and balancing has been developed which comprises, for each individual, an analysis of dynamics and gravitation concurrent with a procedure of weight placement in footwear. The method is summarized in the following steps:

First: Determination of any dynamic fore-aft misalignment with respect to the direction of movement, and whether the misalignment is toe-out or toe-in;

Second: Application of an initial weight to the footwear on the outside edge of said footwear if the dynamic fore-aft misalignment is toe-out, or on the inside edge of the footwear if the dynamic fore-aft misalignment is toe-in.

Third: Iterative redetermination of dynamic fore-aft alignment and further addition, or removal, of weight at the outside edge of the footwear if the dynamic fore-aft misalignment is toe-out, or at the inside edge of the footwear if the dynamic fore-aft misalignment is toe-in, so as to result in dynamic fore-aft foot alignment.

Additional refinement to the dynamic alignment of the foot may involve the following subsequent steps:

Fourth: Determination of any dynamic roll misalignment in the fore-aft aligned foot, and whether the dynamic roll misalignment is pronation or supination;

Fifth: Application of additional weight as follows:

for pronation, addition of weight on the outside edge of the footwear;

for supination, addition of weight on the inside edge of the footwear;

Sixth: Iterative redetermination of dynamic roll alignment and addition to, or removal of, weight added for roll alignment correction so as to achieve dynamic roll alignment, while adjusting the weight and locating of the fore-aft alignment weight so as to maintain the fore-aft alignment of the foot.

In a step preliminary to the first step indicated above, it may be preferable to determine which foot has the greater fore-aft misalignment, and then continue with the complete procedure for that foot, subsequently applying the procedure to the remaining foot. Such determination of greater fore-aft misalignment may be determined by identification of the non-dominant foot, that is, the foot on the non-dominant side of the body.

DETAILED DESCRIPTION OF THE INVENTION

In the development of, and crucial to the method of the instant invention, it has been determined that the application of weight on the exterior portions of footwear will control and stabilize the dynamic position of the foot while in motion, as in walking or running, and thereby measurably reduce hypermobility of the pelvis and knee. Such correction of the human gait significantly improves the efficiency of movement and reduces motion-induced injuries, including those caused by abnormal muscle use in attempts by the human body at self-correction of an unnatural gait.

The method for correcting human gait by the weighting of footwear is concerned with the dynamic alignment and balance of the foot during the walking or running sequence of motion. Of particular interest is the orientation of the foot during the bipedal pattern of motion described above, at the point, following foot roll, when the foot is flat upon the ground. The position of the foot at this dynamic point provides a reference position whereat the human foot in motion can be aligned and stabilized. Ideally, the foot, at this point in the pattern of motion, is oriented in fore-aft alignment with the direction of travel of the moving human body. Such fore-aft alignment provides the naturally straight gait of maximum efficiency and minimum strain.

Figure 1:
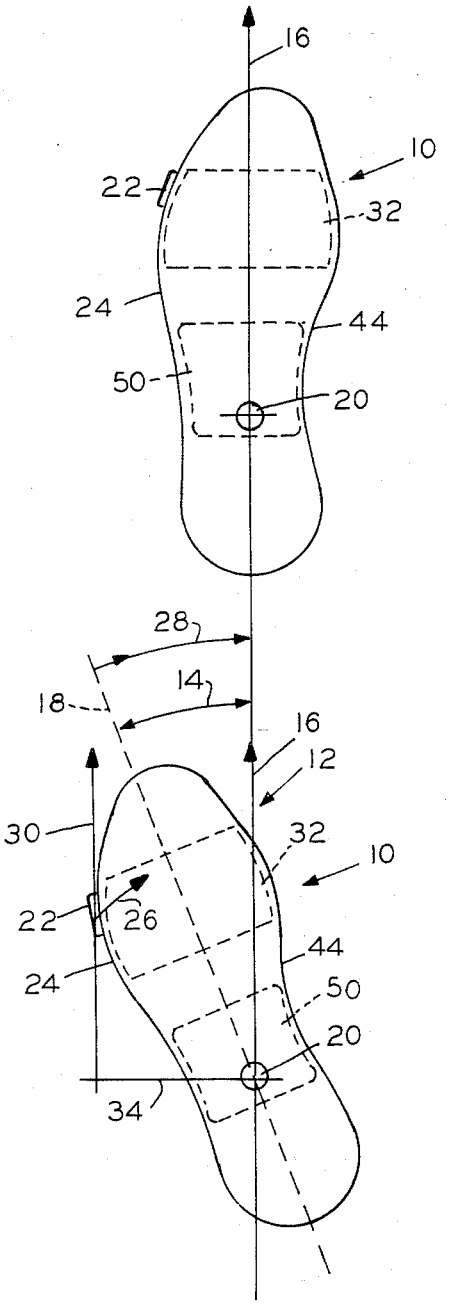
FIG. 1 shows a schematic plan view of a left foot in a toe-out position in the lower view, and in fore-aft alignment in the upper view, illustrating the corrective effect of the addition of weight on the outside edge of the footwear.

Referring now to the drawings, there is shown in the lower view of FIG. 1 a schematic, as viewed from above, of a (left) foot 10 in a toe-out position 12, as represented by the toe-out angle 14 between the line of the fore-aft alignment 16 and the line 18 corresponding to the toe-out position 12. The line of fore-aft alignment 16 represents the direction of travel of the body of which foot 10 is a part. The foot 10 rotates between the toe-out position 12 and the line of fore-aft alignment 16 about an effective fore-aft axis of rotation 20.

As the foot 10 proceeds forward in its swing along line 16, the addition of a weight 22 on the outside edge 24 of the foot 10 provides rotational momentum 26 to the foot 10 about the effective fore-aft axis of rotation 20. The effect of the rotational momentum 26 is a resulting rotation 28 of the foot 10 in a clockwise motion, as viewed from above in FIG. 1, as the foot 10 approaches the ground surface. The momentum of rotation 26 will depend on both the mass of the weight 22 applied and the forward velocity 30 of the foot 10, the greater weight 22 or higher velocity 30 causing greater rotation 28 of the foot 10. Thus, for a given forward velocity 30 of foot 10, there is a weight 22 applicable to the foot 10 which will cause a desired amount of rotation 28, in the instant illustration a rotation 28 in the amount of the toe-out angle 14 to the desired position of fore-aft alignment 16 so that the foot 10 is oriented in the proper fore-aft alignment 16, as shown in the subsequent upper view of FIG. 1.

It is preferred that, to the extent practicable, the weight 22 application to the outside edge 24 of the foot 10 be at the metatarsal 32 portion thereof, thus providing the largest practical moment arm 34 about the effective axis of rotation 20, and therefore the greatest correction per amount of weight. However, practical limitations on the placement of weights on footwear may require variation from this desired placement of weight, as will be described subsequently.

Figure 2:
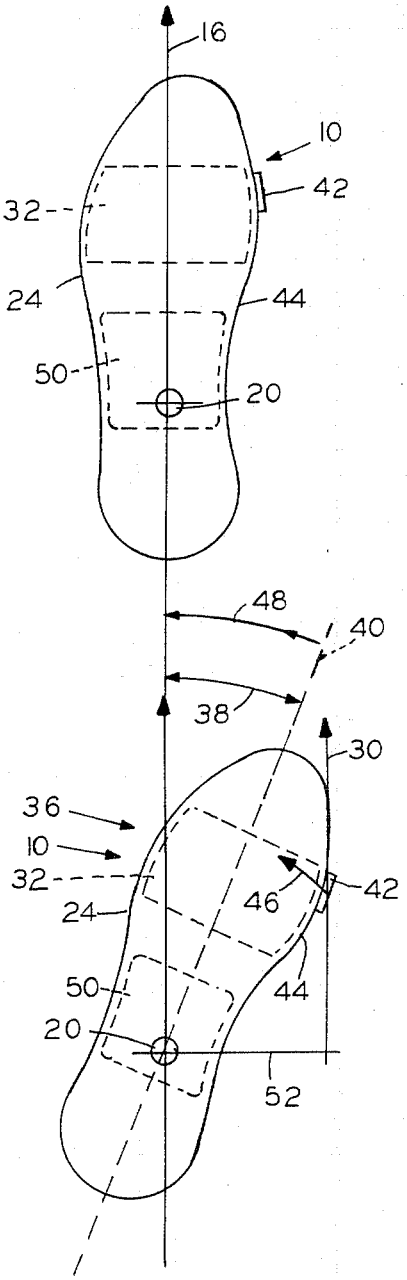
FIG. 2 illustrates a schematic plan view of a left foot in toe-in position in the lower view, and in fore-aft alignment in the upper view, illustrating the corrective effect of the addition of weight on the inside edge of the footwear.

Referring now to FIG. 2, similar analysis would apply to a foot 10 in the less common toe-in position 36, as shown in the lower view of that drawing. In this example, a toe-in angle 38 exists between the line of fore-aft alignment 16 and the line 40 corresponding to the toe-in position 36, the foot 10 rotating about the effective axis of rotation 20. A weight 42 may be placed along the inside edge 44 of the foot 10 so as to create rotational momentum 46 and thus counter-clockwise rotation 48 of the foot 10. As with the toe-out position 12, the forward velocity 30 of the foot 10 and the amount and location of the weight 42 applied determine the amount of counter-clockwise rotation 48 achieved. Again, to the extent practicable, it is preferred to locate the weight 42 along the inside edge 44 of the foot 10 at the metatarsal 32 portion thereof to maximize the moment arm 52 and thus the resulting rotation 48 with respect to the amount of weight applied.

As noted previously, the foot 10 in toe-out alignment 12 tends to pronate while the toe-in 36 foot 10 tends to supinate during the lift off in the sequential motion pattern while walking or running. Correction from either a toe-out position 12 or a toe-in position 36 to the desired fore-aft alignment 16 has proved, in most cases, to be effective in correcting existing pronation or supination of the foot and ankle. However, to provide complete correction of the human gait, additional weighting of the foot 10 may be desirable to correct any residual dynamic pronation or supination. The reference point for the correct dynamic roll alignment 54 of the foot 10 in motion is as for fore-aft alignment 16, that is, when the foot 10, following foot roll, is flat upon the ground surface.

Figure 3:
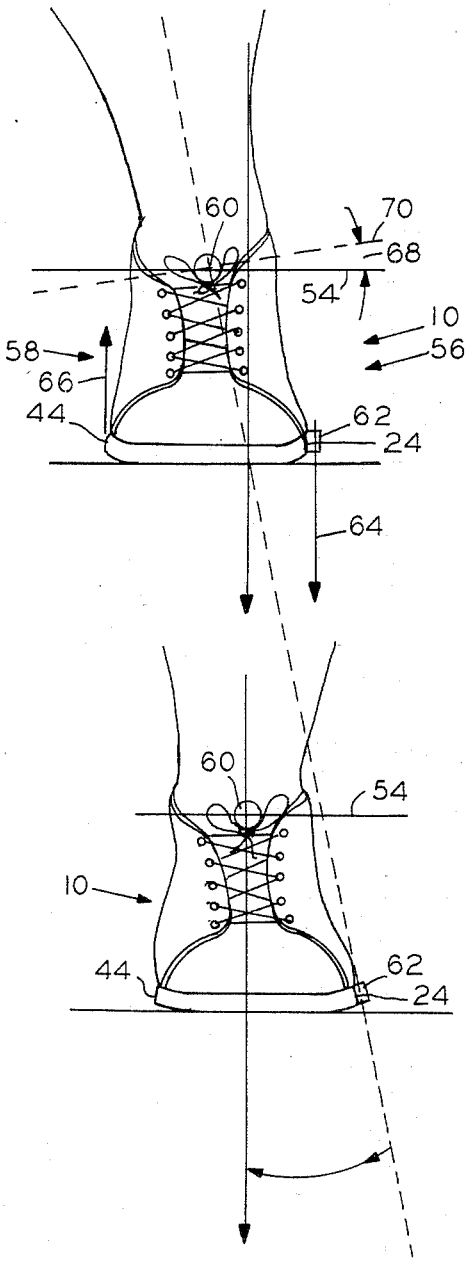
FIG. 3 illustrates a front view of a left foot in footwear in fore-aft alignment but with a pronated condition of roll alignment in the top view, illustrating in the bottom view the corrective effect of the addition of weight on the outside edge of the footwear.

FIG. 3 illustrates in its upper drawing, a front view of a foot 10 which is pronated 56, that is, rolled towards the inside 58 of the foot 10 about an effective roll axis of rotation 60. In this view in FIG. 3, as illustrated, any previous application of weight 22 or 42 (not shown in FIG. 3) for fore-aft alignment 16 has not dynamically balanced the foot 10 about the effective roll axis of rotation 60, the foot 10 being shown to be pronated 56 at the defined reference position. Therefore, what is required is additional weight 62 on the outside edge 24 of the foot 10 to properly balance the foot 10, that is, to rotate downwards, as at 64, the outside edge 24 of the foot 10 about the effective roll axis of alignment 60, thereby lifting the inside edge 44 of the foot 10 at 66 to a balanced position, without pronation or supination. Corrected by the addition of weight 62 is the misalignment represented by the angle of pronation 68 between the line 70 corresponding to the pronated position 56 and the line of dynamic roll alignment or balance 54.

The lower view shows the foot 10 in dynamic roll alignment 54 as a result of the application of weight 62.

Figure 4:
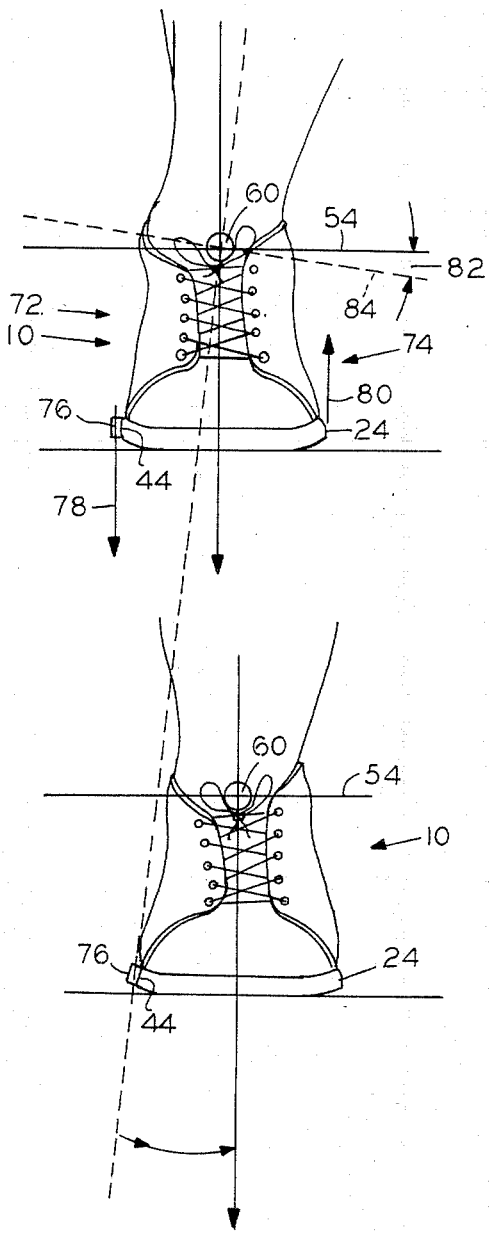
FIG. 4 illustrates a front view of a left foot in footwear in fore-aft alignment but with a supinated condition of roll alignment in the top view, illustrating in the bottom view the corrective effect of the addition of weight on the inside edge of the footwear.

Similarly, FIG. 4, as illustrated in the upper view, presents a front view of a foot 10 which is supinated 72, that is, rolled towards the outside 74 of the foot 10 about the effective roll axis of rotation 60. As in FIG. 3, any previous addition of weight 22 or 42 (not shown in FIG. 4) has either been insufficient to overcome, or has caused, a dynamic unbalancing of the foot 10 about the effective roll axis of rotation 60, the foot 10 in FIG. 4 being supinated 72. Additional weight 76 is required to be added to the inside edge 44 of the foot 10 to properly balance the foot 10, that is, to rotate about the effective axis of roll alignment 60 the inside edge 44 downward, as at 78, and the outside edge 24 upwards, as at 80. Thus corrected by the addition of weight 76 is the misalignment represented by the angle of supination 82 between the line 84 corresponding to the supinated position 72 and the line of roll alignment or balance 54. The lower view of FIG. 4 shows the foot 10 in dynamic roll alignment 54 as a result of the application of weight 76.

Figure 5:
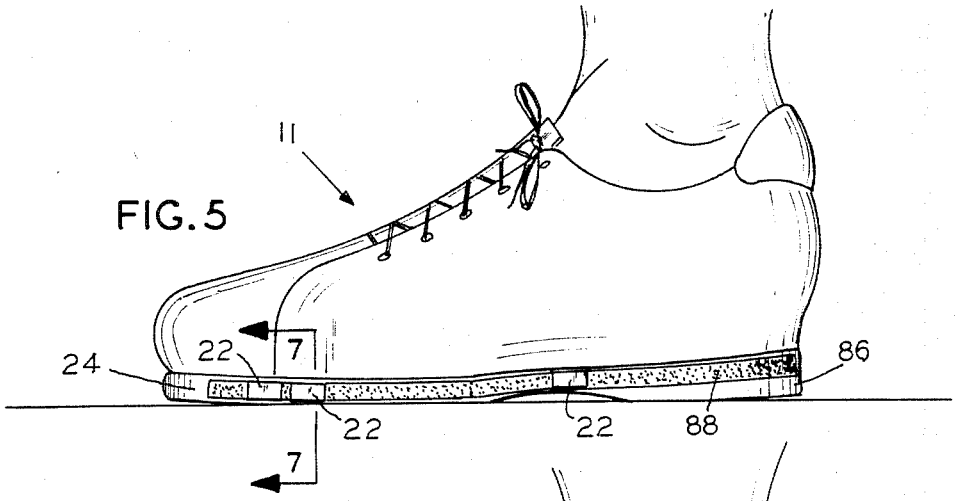
FIG. 5 illustrates the side view of test footwear wherein a continuous weight-fastening strip is shown attached along the outside edge of the footwear for temporary location of weights.
Figure 6:
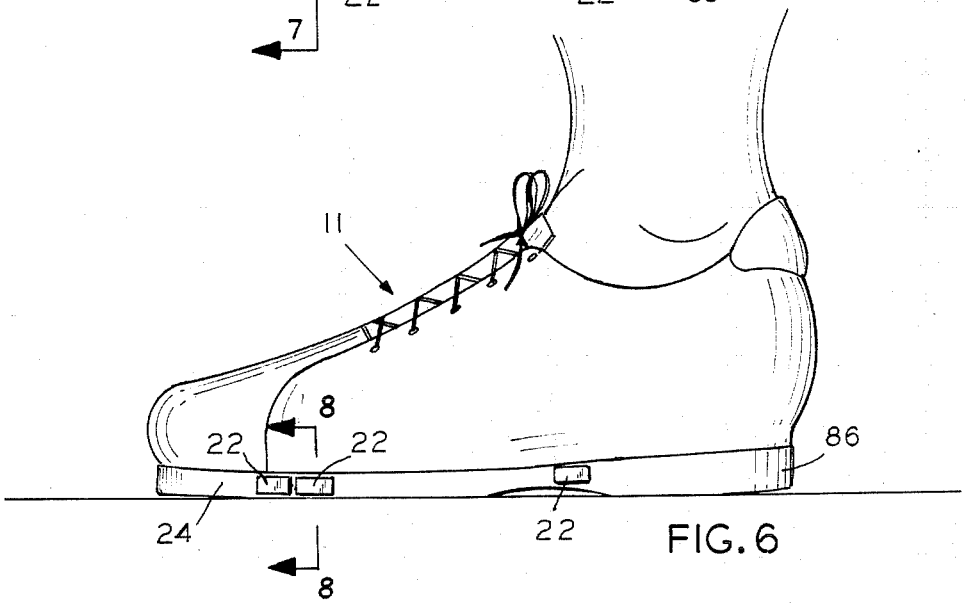
FIG. 6 illustrates a side view of footwear wherein weights have been permanently attached thereto in final location.
Figure 7:
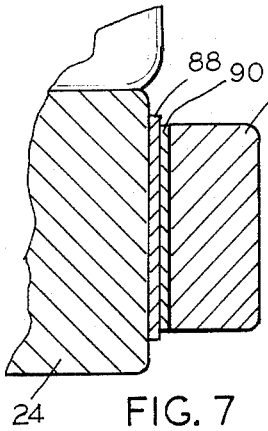
FIG. 7 illustrates a sectional view as seen at line 7—7 of FIG. 5 of a method of temporary attachment of weight.

The manner of affixing the weights 22, 42, 62 and 76 to the foot 10 is through attachment to appropriate footwear 11. FIGS. 5 through 9 are directed to this aspect. In the method or procedure for placement of the weights, as subsequently detailed, it is preferable to have a continuous weight placement capability along the the inside edge 44 and outside edge 24 of the footwear 11 from the metatarsal 30 portion of the foot 10 back to the heel 86. FIG. 5 illustrates a side view of such "test footwear" 11 wherein a strip 88 of hook and loop fastening material, as in VELCRO (trademark of the Velco Corporation) temporarily is attached, as by glueing, or other means, along these inside and outside edges, 44 and 24 respectively, of the footwear 11 (FIG. 5 illustrating the outside edge 24 of a left foot 10). Weights 22, 42, 62 and 76 are prepared with hook and loop fastening material 90 attached thereto, as by glueing or other means, so that the weights 22, 42, 62, and 76 will adhere to, and be readily positionable on the footwear 11 at the location desired for gait correction. FIG. 7 shows a sectional view of such attachment, wherein weight 22, for example, is shown with hook and loop fastening material 90 attached thereto, which weight 22 is thereby temporarily connected for purposes of the procedure to the hook and loop fastening strip 88 which in turn is affixed to the edge 24 of the footwear 11.

Figure 8:
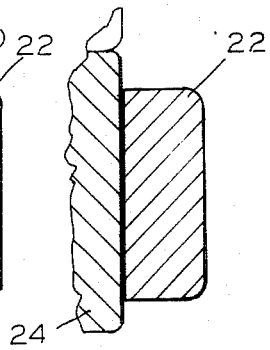
FIG. 8 illustrates a sectional view as seen at line 8—8 of FIG. 6 of a permanent attachment of weight.
Figure 9:
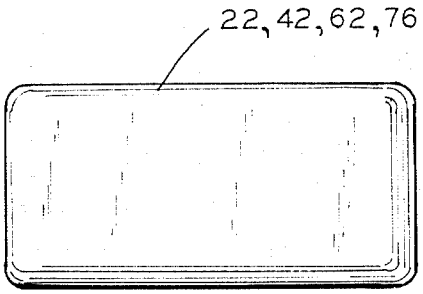
FIG. 9 illustrates a a face view of the weight of FIG. 7 and FIG. 8.

While a continuous hook and loop fastening means strip 88 for weights 22, 42, 62 and 76 is completely satisfactory for the method or procedure leading to the establishment of the desired weight additions and the location of these weight(s) on the footwear 11, it is preferred that a more permanent means of attachment of the weights be used for footwear 11 actually in use. A means of attachment, whereby the weights are directly attached by means of a permanent adhesive on the edges 24 and/or 44 of the footwear 11 in the same location as the temporary weight attachments, has proved to be satisfactory. FIG. 8 shows a sectional view of such direct attachment. One-half ounce weights of lead or other heavy material, extending outwards in profile approximately ¼ inch from the shoe edges 24 or 44, have not encountered retention problems. FIG. 9 shows a face view of a possible weight 22, 42, 62 or 76.

Clearly, however, the above described means of attachment of weights to the footwear is not limited to these means, there being a multitude of alternative weight application means which are useable within the scope of the instant method. Specifically included within the scope of this invention are weights implanted within the soles of the footwear, to include injectible weights. Furthermore, the permanent weights may be of identical weight and location to those placed by the test procedures, or may be involve weights and locations which result in equivalent rotational momentum for fore-aft alignment and gravitational balance for roll alignment, as will be appreciated by persons skilled in the art.

The method which is employed to correct human gait should be readily understood from the previous description. However, for further clarification, a detailed description of the procedure is provided below.

It is preferred in the method for correcting human gait by the weighting of footwear that the procedure be first completed for the foot which has the greatest fore-aft misalignment, with the procedure then repeated for the remaining foot. The foot having the greatest fore-aft misalignment, i.e., the foot with the greatest toe-out angle 14 or toe-in angle 38, may be determined by visual inspection during motion. However, an alternative means of such determination has been found useful. It has been discovered that there is a dominant and a non-dominant side of the body, extending from infancy. In motion, as in walking or running, the dominant side pulls and the non-dominant side follows. In the "infancy walking" stage, the natural inclination is to walk with a "toe-out" gait, that is, with an external rotation of the foot, for balance and stability. As the individual grows older, the motion of the dominant side foot approaches closer to the desired fore-aft alignment while the non-dominant foot lags. Thus, in a determination of the foot having the greater fore-aft misalignment, the determination of the non-dominant foot has been found to be appropriate in most cases.

The foot on the non-dominant side of the body having been determined, any existing dynamic fore-aft misalignment of that foot with respect to the direction of movement is visually determined during motion as to whether such misalignment is toe-in or toe-out, the latter being more common. The position of reference for determination of fore-aft alignment 16 is, during the sequence of motion, when the foot, following foot roll, is flat upon the running or walking surface. It has been found useful, in visualizing the alignment of the foot at the reference position, to have the person in motion, walk or run on a level treadmill operating at essentially the pace of concern.

If the dynamic fore-aft alignment is toe-out 12, the weight 22 is applied to the outside edge 24 of the foot 10, on the footwear 11, so as to achieve rotational momentum 26 about the effective fore-aft axis of rotation 20, and thus physical rotation 28 of the foot 10 toward the desired line of fore-aft alignment 16. A preferred location for the initial application of weight 22 is along at the outside edge 24 of the footwear at the metatarsal 32 area of the foot 10 wherein the initial weight 22, generally ½ ounce of lead or other heavy material, will have the maximum moment arm 34 for the rotation 28 of the foot 10. Should the initial dynamic fore-aft misalignment be toe-in 36, a similar application of weight 42 preferably is applied to the footwear 11 along the inside edge 44, at the metatarsal 32 portion of the foot 10 for maximum moment arm 52.

The initial corrective weight, 22 or 42, having been applied, the dynamic fore-aft alignment is redetermined visually. If, with an initial outside edge 24 application to correct a toe-out position 12, there remains a dynamic toe-out position 12, additional weight 22 is added to the outside edge 24 of the footwear 11, either at the location of the first weight 22, or adjacent thereto, along the continuous weight application strip 88 temporarily applied to the footwear 11, as shown in FIG. 5. Additional weight 22 preferably is added in small ½ ounce increments, between redeterminations of dynamic fore-aft alignment. Clearly, following application of the original weight 22, should the dynamic fore-aft alignment have come to a toe-in 36 position, weight must either be removed, or shifted on the footwear 11 so that the momentum arm 34 is decreased. Thus a series of iterative redeterminations of dynamic fore-aft alignment and further addition, or removal of, weight along the outside edge 24 of the footwear 11 is continued until the desired fore-aft foot alignment 16 is attained.

A similar procedure is followed if the initial application of weight 42 was along the inside edge 44 of the footwear 11 to correct a toe-in 36 position; weight 42 iterively being added or removed along the inside edge 44 of the footwear 11 to vary the rotational momentum 46, so as to ultimately achieve rotation 48 of the foot 10 to the desired fore-aft alignment 16.

While the application of weight 22 or 42 for fore-aft alignment generally also has corrective effect for unbalanced or misaligned dynamic roll alignment, it may be desirable to make additional weight adjustments to specifically adjust dynamic roll alignment 54 so as to achieve total correction of the human gait. Thus, following the correction of fore-aft alignment 16, the existance of dynamic roll misalignment is determined, together with whether any such dynamic roll misalignment is pronation or supination. If a pronation position 56 exists, as illustrated in FIG. 3, additional weight 62 is added on the outside edge 24 of the footwear 11 so as to dynamically rebalance the foot 10 to a position of roll alignment 54. Similarly, for supination, as shown in FIG. 4, additional weight 76 is added on the inside edge 44 of the foot 10 to alter the dynamic balance to the proper roll alignment 54 by downward rotation 78 at the inside edge 44 relative the the outside edge 22 thereof.

As with dynamic fore-aft foot alignment 16, the result of dynamic roll alignment 54 requires an iterative redetermination of roll alignment with the addition or removal of weight 62 or 76 at each revisualization so as to ultimately result in dynamic roll alignment 54. However, in addition to affecting dynamic roll alignment 54, the addition or removal of weights 62 or 76 at this time will also affect the previously corrected fore-aft alignment 16. Therefore, the iterative redetermination of roll alignment 54 must also be accomplished by additional adjustment of the amount and/or location of weight 22 or 42 so as to maintain the fore-aft alignment 16. While the instant description, for the purpose of clarity, refers separately to weight 22 and 42 for fore-aft alignment 16 and weight 62 and 76 for roll alignment 54, clearly the application of any weight 22, 42, 62 or 76 will have an effect on both types of alignment 16 and 54.

The combined application of weights 22, 42, 62 or 76 to result in both fore-aft alignment 16 and roll alignment 54 can be achieved in a number of ways. A preferred method of application of additional weight 62 or 76 for dynamic roll alignment 54 is as follows:

with pronation and previously applied outside edge 24 metatarsal 32 weight 22, the addition of weight 62 at the outside edge 24 mid-sole area 50 while moving weight 22 rearwards as necessary to maintain dynamic fore-aft alignment 16;

with supination and previously applied outside edge 24 metarsal 32 weight 22, the addition of weight 76 to the inside 44 mid-sole area 50 while adding additional outside edge 24 weight 22 as necessary to maintain dynamic fore-aft alignment 16;

with supination and previously applied inside edge 44 metatarsal 32 weight 42, the addition of weight 76 at the inside edge 44 mid-sole area 50, while moving the inside edge 44 metatarsal 32 weight 42 rearwards as necessary to maintain the dynamic fore aft alignment 16; and with pronation and previously applied inside edge 44 metarsal 32 weight 42, the addition of weight 62 on the outside edge 24 midsole area 50 while adding additional inside edge 44 weight 42 as necessary to maintain the dynamic fore-aft alignment 16.

With completion of the addition of weights to achieve dynamic fore-aft alignment 16 or both dynamic fore-aft alignment 16 and dynamic roll alignment 54, if desired, on the non-dominant foot (having the greatest amount of fore-aft misalignment), the same procedure is applied to the other foot. It is, of course, desirable, upon completion of alignment correction on both feet, to make a final visualization that the alignments are as desired.

As described previously, during the weight addition and location process, test footwear 11 with continuous, temporary locations for weight placement are preferred. Upon final determination of corrective weight(s) and location(s), that pattern of weight and location may be translated to footwear wherein the weights are applied in the more permanent manner, either in the same pattern or a pattern which provides equivalent results with respect to rotational momentum and roll balance.

The application of the aforesaid method of weighting footwear to correct inefficiency and abnormalities in the human gait will improve the efficiency of the cycle of motion while running or walking, and will significantly reduce the number of injuries occurring during such motion activities. It is thought that the method of correcting human gait by the weighting of footwear of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

We claim:

1. A method for correcting human gait by the weighting of footwear, comprising the following steps:

a. determination of any dynamic fore-aft misalignment with respect to the direction of movement, and whether said misalignment is toe-out or toe-in;

b. application of a weight to the footwear on the outside eage of said footwear if said dynamic fore-aft misalignment is toe-out, or on the inside edge of said footwear if said dynamic fore-aft misalignment is toe-in; and c. iterative redetermination of dynamic fore-aft alignment and further addition to, or removal of, weight at said outside edge of said footwear if said dynamic fore-aft misalignment is toe-out, or at said inside edge of said footwear if said dynamic fore-aft misalignment is toe-in, so as to result in dynamic fore-aft foot alignment.

2. The method for correcting human gait by weighting of footwear, as recited in claim 1, wherein said application of weight is located, to the extent practicable, on the footwear in proximity to the metatarsal portion of the foot.

3. The method for correcting human gait by weighting of footwear, as recited in claim 1, wherein the following additional and subsequent steps are added:

a. determination of any dynamic roll misalignment in the fore-aft aligned foot, and whether said dynamic roll misalignment is pronation or supination;

b. application of additional weight as follows:

for pronation, addition of weight on the outside edge of the footwear;

for supination, addition of weight on the inside edge of the footwear; and c. iterative redetermination of dynamic roll alignment and addition to, or removal of, weight added for roll alignment correction so as to achieve dynamic roll alignment, while adjusting the weight and location of the fore-aft alignment weight so as to maintain the fore-aft alignment of the foot.

4. The method for correcting human gait by weighting of footwear, as recited in claim 1, wherein is added:

the preliminary step of determining that foot which has the greatest fore-aft misalignment; and proceeding with the sequence of steps with that foot.

5. The method for correcting human gait by weighting of footwear, as recited in claim 4, wherein the determination of the foot which has the greatest fore-aft misalignment is accomplished by identifying the non-dominant foot, that is, the foot on the non-dominant side of the body.

6. The method for correcting human gait by weighting of footwear, as recited in claim 4, wherein an additional step includes repeating the above sequence of steps with the remaining foot.

7. A method for correcting human gait by the weighting of footwear, comprising the following steps:

a. determination of the non-dominant side of the body;

b. determination of any dynamic fore-aft misalignment, with respect to the direction of movement, on the foot on said non-dominant side of the body, and whether said misalignment is toe-in or toe-out;

c. application of an initial weight to the footwear at the metatarsal portion of the foot and on the outside edge of said footwear if said dynamic fore-aft alignment is toe-out, or on the inside edge of said footwear if said dynamic fore-aft alignment is toe-in;

d. iterative redetermination of dynamic fore-aft alignment, and further addition to, or removal of, or repositioning of weight at said outside edge of said footwear if said dynamic fore-aft alignment is toe-out, or at the inside edge of said footwear if said dynamic fore-aft alignment is toe-in; so as to result in dynamic fore-aft foot alignment;

e. determination of any dynamic roll misalignment in the fore-aft aligned foot, and whether said dynamic roll misalignment is pronation or supination;

f. application of additional weight as follows:

for pronation, additional weight as follows: edge of the footwear;

for supination, addition of weight on the inside edge of the footwear;

g. iterative redetermination of roll alignment and addition to, or removal of, weight added for roll alignment correction so as to achieve roll alignment, while adjusting the weight and location of the fore-aft alignment weight so as to maintain the fore-aft alignment of the foot; and h. repeat the process for the foot on the dominant side of the body.

8. The method for correcting human gait by weighting of footwear, as recited in claim 7, wherein the iterative reapplication of additional weight for dynamic roll alignment includes the following:

with pronation and previously applied outside edge metatarsal weight, the addition of weight at the outside edge mid-sole area while moving weight rearwards as necessary to maintain dynamic fore-aft alignment;

with supination and previously applied outside edge metarsal weight, the addition of weight to the inside mid-sole area while adding additional outside edge weight as necessary to maintain dynamic fore-aft alignment;

with supination and previously applied inside edge metatarsal weight, the addition of weight at the inside edge mid-sole area, while moving the inside edge metatarsal weight rearwards as necessary to maintain the dynamic fore aft alignment; and with pronation and previously applied inside edge metarsal weight, the addition of weight on the outside edge midsole area while adding additional inside edge weight as necessary to maintain the dynamic fore-aft alignment.

* * * * *